US006358071B1

(12) United States Patent
Moga

(10) Patent No.: US 6,358,071 B1
(45) Date of Patent: Mar. 19, 2002

(54) ELECTRICAL CONNECTION FOR A SPARK PLUG AND METHOD OF ASSEMBLING THE SAME

(75) Inventor: Viorel N. Moga, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/636,402

(22) Filed: Aug. 10, 2000

(51) Int. Cl.[7] ..... H01R 13/44
(52) U.S. Cl. ..... 439/125; 439/127
(58) Field of Search ..... 439/125, 127, 439/128, 126, 890, 893

(56) References Cited

U.S. PATENT DOCUMENTS 1,821,443 A * 9/1931 Mohr ..... 439/125
5,685,282 A * 11/1997 Murata et al. ..... 123/635
5,957,706 A * 9/1999 Phillips, Jr. et al. ..... 439/127

* cited by examiner

*Primary Examiner*—Gary Paumen
*Assistant Examiner*—Ross Gushi
(74) *Attorney, Agent, or Firm*—Margaret A. Dobrowitsky

(57) ABSTRACT

An electrical connection between a high voltage terminal and a spark plug head. A case contains a high voltage terminal connected to a high voltage source. A connector portion extends from a bottom portion of the case, which in turn is secured to an insulator boot for attachment to a spark plug. The high voltage terminal has a nipple extending within the connector portion. A leaf spring member engages the nipple and is positively retained thereto. The head of the spark plug is inserted into the connector portion and engages the leaf spring member. The resilient characteristics of the leaf spring member provided by the interaction of the leaf spring member and the connector portion enable a compact yet positive connection system.

1 Claim, 3 Drawing Sheets

ELECTRICAL CONNECTION FOR A SPARK PLUG AND METHOD OF ASSEMBLING THE SAME

BACKGROUND OF THE INVENTION a) Field of the Invention

The present invention relates to a connection between a high voltage terminal and a ark plug head and more particularly to a spark plug connector comprising a multi-point contact system having an increased spring force interface, a compact packaging system, and reduced parts.

b) Description of Related Art

Electrical connections between a high voltage terminal and a spark plug head are well known in the art. Typically, a high voltage lead wire extends from a central high voltage source coil assembly. The lead wire contains a high voltage metal sheath with an insulating coating. The metal conductor sheath is connected to a connector usually formed of stamped sheet metal which forms an encircling clamp that snaps onto the spark plug head. An insulating boot is also provided to cover the connection between the high voltage lead wire and the spark plug. This arrangement does not provide any tolerance when assembling the connection. The resilient insulating boot must be sufficiently disposed over the spark plug before the connection can be made with the spark plug head. Furthermore, these prior art arrangements often result in the disconnection between the clamp and metal sheath when the lead wire is disconnected from the spark plug.

It is also know to employ a spring within an electrical connection of a spark plug head. However, prior art connections employing springs are complex, costly, and do not reliably provide a positive attachment of the spring to the high voltage terminal. Moreover, the prior art devices require complicated techniques and specialized tools to assemble.

Several prior art spark plug springs are being used in ignition coil applications. Most of the conventional designs use a helical compression spring to make the contact between the coil and the spark plug. Some of the conventional designs use a c-spring to make contact and also retain the high voltage lead along with the boot to the spark plug. Such a contact has a cylindrical cavity that contains the tip of the spark plug and a leaf spring in a c-shape that ensures a permanent contact to the spark plug and also retains the spark plug wire or the coil on the spark plug.

The need exists for an improved connector between the spark plug and the high voltage terminal, whereby the connector system is more compact, allows some tolerance on the location of the spark plug with respect to the engine well, and allows high spring retention to improve the connector interface.

SUMMARY OF THE INVENTION

To solve problems inherent in the prior art, the present invention provides a unique, yet simplified design for an electrical connection between a spark plug head and a high voltage terminal facilitating easy assembly.

To achieving the objectives and improved structure of the present invention, an electrical connection comprises a resilient three-point contact spring formed as a three part leaf-spring connector that snaps over the spark plug head. A case member biases the contact spring into a positive engagement working position.

With the structural arrangement of this invention, the tip of the spark plug is pinched or contacted from three directions that are spaced apart by 120 degrees. The leaf-springs do not take up space axially, therefore the package is more compact. By providing three contact points along with a higher spring load, there is a higher chance of maintaining a permanent contact between the spark plug and the high voltage terminal. In addition, the high spring retention system offers the possibility of eliminating the use of a bracket, the need for a mounting boss on the cam cover, the use of a bolt, and eliminates one operation in the engine assembly plant. Moreover, the proposed inventive design will allow radial flexibility on the location of the coil or the spark plug wire with respect to the tip of the spark plug.

In the preferred embodiment, the three part leaf-spring member of this invention is a stamped part, where a brass or zinc contact is a cast part that is followed by a secondary operation to remove burrs from the surfaces that contacts the spring.

Other objectives and features of the invention will become apparent from the following description.

BRIEF DESCRIPTION OF THE DRAWINGS

Additional objects and advantages of the present invention will be more readily apparent from the following detailed description of preferred embodiments thereof, when taken together with the accompanying drawings in which.

DETAILED DESCRIPTION OF THE PREFERRED EMBODIMENTS

The preferred embodiments of the present invention are hereinafter described with reference to the accompanying drawings.

Figure 1:
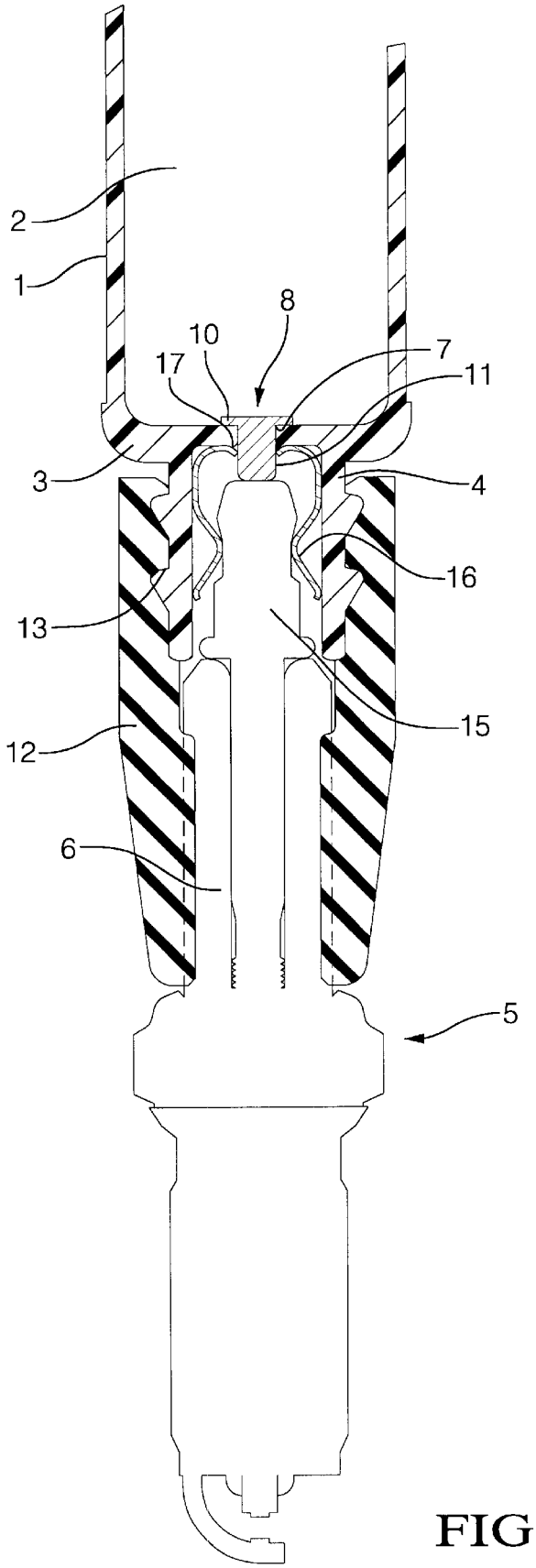
FIG. 1 is a sectional view of the spark plug connection according to the present invention.

FIG. 1 depicts the electrical connection according to the present invention. A case member 1 has a central housing 2 adapted to contain a pencil coil arrangement as may be known to one of skill in the art. The central housing 2 may house a terminal lead wire extending from a centrally located coil. The case 1 extends to the bottom portion 3, from which a connector portion 4 extends toward the ceramic insulator portion 6 of the spark plug 5. The connector portion 4 is preferably a hollow tube extending from the bottom portion 3 of the case member 1 and having outwardly extending ridges or barbs 13. A high voltage terminal 8 extends through a bore 7 extending through the bottom portion 3 of the case 1. A nipple 9 having a widened seating portion 10 and a mounting post 11 extending along the central axis of the case member within the connector portion 4. An insulating boot 12 made of a resilient material is secured to the connector portion 4 via barbs 13 extending outwardly from the connector portion 4. The insulator boot 12 extends about and frictionally engages the ceramic insulator 6 to maintain a connection therebetween.

The spark plug head 15 is disposed within the insulator boot 12 and connector portion 4 of the case 1. A three-part leaf spring member 16 is disposed between the spark plug head 15 and the nipple 9. One first end 17 of the leaf spring member 16 has a central aperture 17*a* sized to be frictionally fitted onto the post 11. In one embodiment, the post 11 is formed with a circumferential groove 11*a* formed to receive the first end 17 of the leaf spring member 16 providing an interlocking friction fit therebetween. Such an arrangement prevents the leaf spring member from accidentally being dislodged from the high voltage terminal when the spark plug head 15 is removed.

As shown in FIG. 1, the leaf spring member 16 comprises a plurality of contact legs 16*a* (two legs 16*a* are shown in FIG. 1 but any number suitable number may be provided; however, three legs 16*a* are provided in the preferred embodiment).

Figure 2:
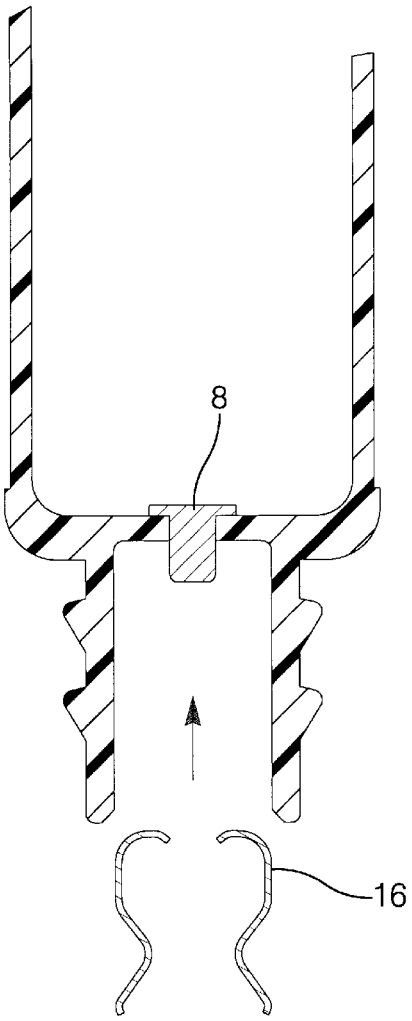
FIG. 2 is a sectional view of the spark plug high voltage tower connection of FIG. 1 in a pre-assembled state.
Figure 3:
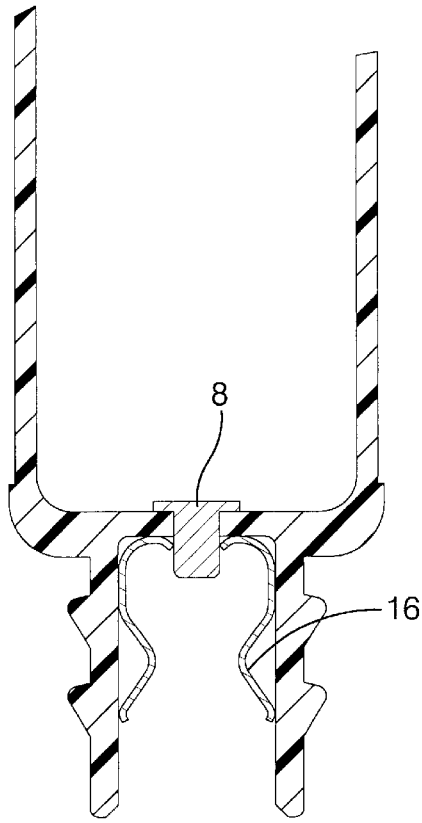
FIG. 3 is a sectional view of the spark plug high voltage tower connection of FIG. 2 after assembly with the spark plug omitted.
Figure 4:
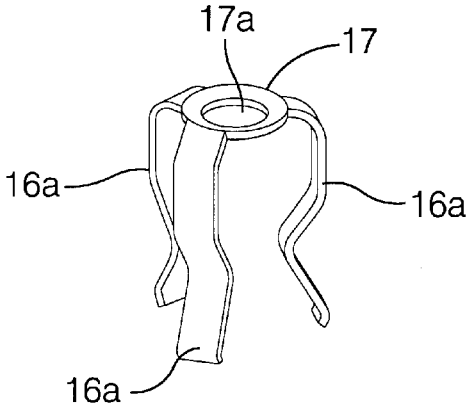
FIG. 4 is an enlarged perspective view of the multi-legged leaf spring member.
Figure 5:
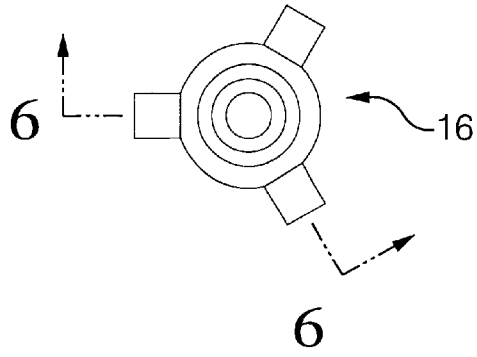
FIG. 5 illustrates a top side view of the multi-legged leaf spring member of FIG. 4.
Figure 6:
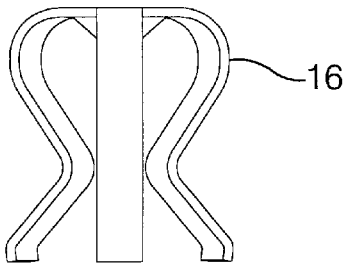
FIG. 6 is a side view of the multi-legged leaf spring member of FIG. 4.
Figure 7:
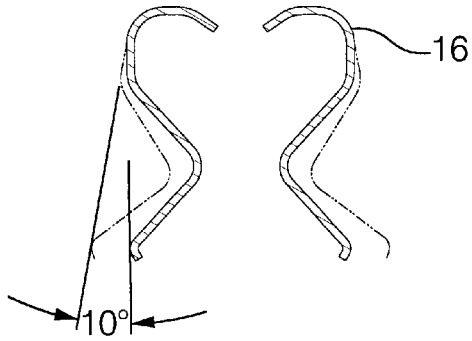
FIG. 7 is a cross sectional view of the multi-legged leaf spring member of FIG. 4 taken along section line VII—VII of FIG. 5.

With reference to FIGS. 2 and 3, the structural interaction of the leaf spring 16 and the connector portion 4 will now be described. As shown in FIG. 2, the leaf spring member 16 is inserted into the cavity defined by the connector portion 4 and, during insertion, the contact legs 16*a* are slightly compressed (about 10 degrees) by the walls of the connector portion 4. After assembly of the leaf spring onto the post 11, the contact legs 16*a* assume the position shown in FIG. 3. With the arrangement of this invention, the various spring forces between the contact legs 16*a* and the spark plug head 15 can be accurately controlled by the dimensions and design of the leaf spring 16. In other words, various dimensions including, but not limited to, the thickness and width of each contact leg 16*a,* the inside diameter of the connector portion 4, the material of the leaf spring member 16, and the shape and arrangement of each contact leg 16*a* define the spring forces between the leaf spring member 16 and the spark plug head 15.

As depicted by the illustration of the three-part leaf spring 16, the connector assembly of this invention provides a unique, yet simplified design for an electrical connection between a spark plug head and a high voltage terminal facilitating easy assembly. The present invention is an electrical connection comprising a resilient multi-point contact spring formed as a leaf-spring connector that snaps over the spark plug head. A case member biases the contact spring into a positive engagement working position.

With the structural arrangement of this invention, the tip of the spark plug is pinched or contacted from multiple directions that are uniformly spaced apart. The leaf-spring member does not take up space axially, therefore the package is more compact. By providing three contact points along with a higher spring load, there is a higher chance of maintaining a permanent contact between the spark plug and the high voltage terminal. In addition, the high spring retention system offers the possibility of eliminating the use of a bracket, the need for a mounting boss on the cam cover, the use of a bolt, and eliminates one operation in the engine assembly plant.

In the preferred embodiment, the three part leaf-spring member of this invention is a stamped part, where a brass or zinc contact is a cast part that is followed by a secondary operation to remove burrs from the surfaces that contacts the spring.

Although the present invention has been fully described in connection with the preferred embodiment thereof with reference to the accompanying drawings, it is to be understood that various changes and modifications will become apparent to those of skill in the art without departing from the spirit and scope of the instant invention.

What is claimed is:

1. An electrical connection for a spark plug, comprising:

a case having a high voltage terminal adapted to be connected to a high voltage source for exciting said spark plug;

a connector portion extending from said case, said connector portion defining a cavity sized to receive a head of said spark plug therein;

an insulating boot secured to said case and adapted to be connected to said spark plug; and a leaf spring member secured to said high voltage terminal and resiliently acting on an inner peripheral surface of said connector portion, said leaf spring member adapted to bear against said head of said spark plug thereby establishing an electrical connection between said leaf spring member and said head, wherein said high voltage terminal comprises a post member, said leaf spring member being fitted onto said post member to thereby provide a positive connection therebetween, and wherein said leaf spring member comprises:

a first end having a central aperture configured to frictionally fit onto said post, said first end being generally disk-shaped; and a plurality of resilient legs extending along a longitudinal direction of said connector, said first end and said legs comprising electrically conductive material.

* * * * *